US008807284B2

(12) United States Patent
Sonnenmoser et al.

(10) Patent No.: US 8,807,284 B2
(45) Date of Patent: Aug. 19, 2014

(54) ELEVATOR WITH A MONITORING SYSTEM

(75) Inventors: Astrid Sonnenmoser, Ebikon (CH); David Michel, Thalwil (CH); Martin Hess, Baar (CH)

(73) Assignee: Inventio AG, Hergiswil (CH)

( * ) Notice: Subject to any disclaimer, the term of this patent is extended or adjusted under 35 U.S.C. 154(b) by 546 days.

(21) Appl. No.: 13/203,320

(22) PCT Filed: Feb. 24, 2010

(86) PCT No.: PCT/EP2010/052332

§ 371 (c)(1), (2), (4) Date: Aug. 25, 2011

(87) PCT Pub. No.: WO2010/097404

PCT Pub. Date: Sep. 2, 2010

(65) Prior Publication Data

US 2011/0303492 A1 Dec. 15, 2011

(30) Foreign Application Priority Data

Feb. 25, 2009 (EP) ..... 09153654

(51) Int. Cl.
*B66B 1/28* (2006.01)

(52) U.S. Cl.
USPC ..... 187/248; 187/391

(58) Field of Classification Search
USPC ..... 187/247, 248, 391–393
See application file for complete search history.

(56) References Cited

U.S. PATENT DOCUMENTS

| | | | | |
|---|---|---|---|---|
| 4,350,225 | A * | 9/1982 | Sakata et al. | 187/248 |
| 4,473,135 | A * | 9/1984 | Yonemoto | 187/248 |
| 4,567,560 | A * | 1/1986 | Polis et al. | 700/79 |
| 5,387,769 | A * | 2/1995 | Kupersmith et al. | 187/248 |
| 5,561,277 | A * | 10/1996 | Bockhold et al. | 187/247 |
| 6,173,814 | B1 * | 1/2001 | Herkel et al. | 187/288 |
| 7,237,653 | B2 * | 7/2007 | Chida | 187/248 |
| 7,500,650 | B2 * | 3/2009 | Deplazes et al. | 254/275 |
| 7,896,135 | B2 * | 3/2011 | Kattainen et al. | 187/248 |
| 8,096,387 | B2 * | 1/2012 | Kattainen et al. | 187/248 |
| 8,365,872 | B2 * | 2/2013 | Ueda | 187/393 |

FOREIGN PATENT DOCUMENTS

WO 03107295 A2 12/2003

* cited by examiner

*Primary Examiner* — Anthony Salata
(74) *Attorney, Agent, or Firm* — Fraser Clemens Martin & Miller LLC; William J. Clemens

(57) ABSTRACT

An elevator has a control unit, a bus, a first microprocessor and at least a second microprocessor, which microprocessors are associated with a bus junction and which are connected by the bus with the control unit. The control unit communicates an instruction by the bus to the second microprocessor to interrupt a signal transmission to the first microprocessor so that the first microprocessor transmits a status message to the control unit.

11 Claims, 8 Drawing Sheets

1a, 1b RFID Tag
3a, 3b RFID System
4 Microprocessor
5 Microprocessor
10 Control Unit

ELEVATOR WITH A MONITORING SYSTEM

FIELD OF THE INVENTION

The invention relates to an elevator with a monitoring system for monitoring a status of associated microprocessors.

BACKGROUND OF THE INVENTION

WO 03/107295 A1 shows a monitoring system for status monitoring of peripheral apparatus, for example elevator components. For that purpose the bus system has a bus, a central control unit, which is connected with the bus, and several peripheral apparatus. Each of these apparatus lies at a bus junction and communicates with the control unit by means of the bus. At every point in time the peripheral apparatus adopt a specific status. The control unit periodically interrogates the states of each peripheral apparatus by way of the bus.

The bus is supplied with energy by the control unit and supplies electromagnetic induction loops which are part of a bus junction. The individual peripheral apparatus are coupled to the induction loops of the bus junctions by way of a local antenna and draw electromagnetic energy via the associated induction loop. By way of the induction loop the peripheral apparatus also informs the control unit its identification code and its instantaneous status when each interrogation takes place. Thanks to this identification code the control unit can allocate the read status to a specific peripheral apparatus.

The advantage of such a monitoring system is the simple connection between the bus and peripheral apparatus by means of the induction loops. A complicated and expensive cabling of the peripheral apparatus is redundant.

However, the periodic interrogation of the status of the peripheral apparatus by way of the bus has a disadvantageous effect. Since the control unit actively interrogates each peripheral apparatus the bus communicates two signals for each interrogation and peripheral apparatus. In the case of relatively short interrogation cycles, particularly with safety-relevant peripheral apparatus, and a relatively high number of such apparatus a multiplicity of signals is exchanged between the control unit and peripheral apparatus. This means that the control unit has high computing capacities in order to process all signals. In addition, the bus is strongly loaded and provides high signal transmission capacities in order to communicate all status interrogations. Accordingly, the control unit and the bus are expensive.

SUMMARY OF THE INVENTION

It is therefore an object of the present invention to further improve known monitoring systems for an elevator.

According to one exemplifying embodiment the elevator comprises a control unit, a bus, at least one first microprocessor and a second microprocessor, which are associated with a bus junction and which are connected with the control unit by way of the bus. The elevator is distinguished by the fact that the control unit communicates an instruction by way of the bus to the second microprocessor to interrupt a signal transmission to the first microprocessor so that the first microprocessor transmits a status message to the control unit.

The advantage of this elevator resides in the simple and reliable checking of the functional capability of the first microprocessor. In that case, the spontaneous response behavior of the first microprocessor is provoked in that the second microprocessor interrupts the transmission of the status signal to the first microprocessor and thus, for example, simulates the occurrence of a risk state.

In a preferred exemplifying embodiment at least one code-carrying element and at least one code-reading element are associated with the bus junction in the elevator. The code-reading element contactlessly reads an identification code from the code-carrying element and transmits a signal to the first microprocessor.

The code-carrying element and the code-reading element preferably each have an induction loop. The code-reading element contactlessly supplies the code-carrying element with electromagnetic energy by means of the two induction loops. The code-carrying element contactlessly communicates its identification code to the code-reading element by means of the two induction loops.

The contactless status monitoring of an elevator component is particularly advantageous. The employed sensor components comprising the code-carrying and the code-reading elements are hardly subject to wear in operation. Maintenance costs can thereby be lowered and monitoring reliability increased.

In addition, the code-carrying and code-reading elements are, for example, obtainable in construction as a passive or an active RFID system as a mass-production item and are extremely economic.

In a further preferred exemplifying embodiment the code-reading element transmits the signal to at least the first microprocessor by means of a data line. The second microprocessor actuates a switch for interruption of the data line or a switch for interruption of an energy supply of the code-reading element. Finally, the control unit confirms the status message of the first microprocessor by way of the interruption of the signal transmission by the second microprocessor.

If the control unit cannot confirm the provoked status message of the first microprocessor it is assumed therefrom that at least the first or second microprocessor has faulty functioning and the status monitoring is no longer secure.

The advantage of this test resides in the fact that a continuing interrogation of the status signals, which are received from the first microprocessor, by the control unit is redundant. As long as the functional capability of the first microprocessor is established by the control unit it is sufficient if the first microprocessor communicates a status message to the control unit only on occurrence of a potentially risky state of the elevator. The number of signals to be processed thereby reduces. Less expensive buses and control units can thus be employed.

DESCRIPTION OF THE DRAWINGS

The invention is clarified and described in further detail in the following by exemplifying embodiments and drawings, in which.

DETAILED DESCRIPTION OF THE INVENTION

Figure 1:
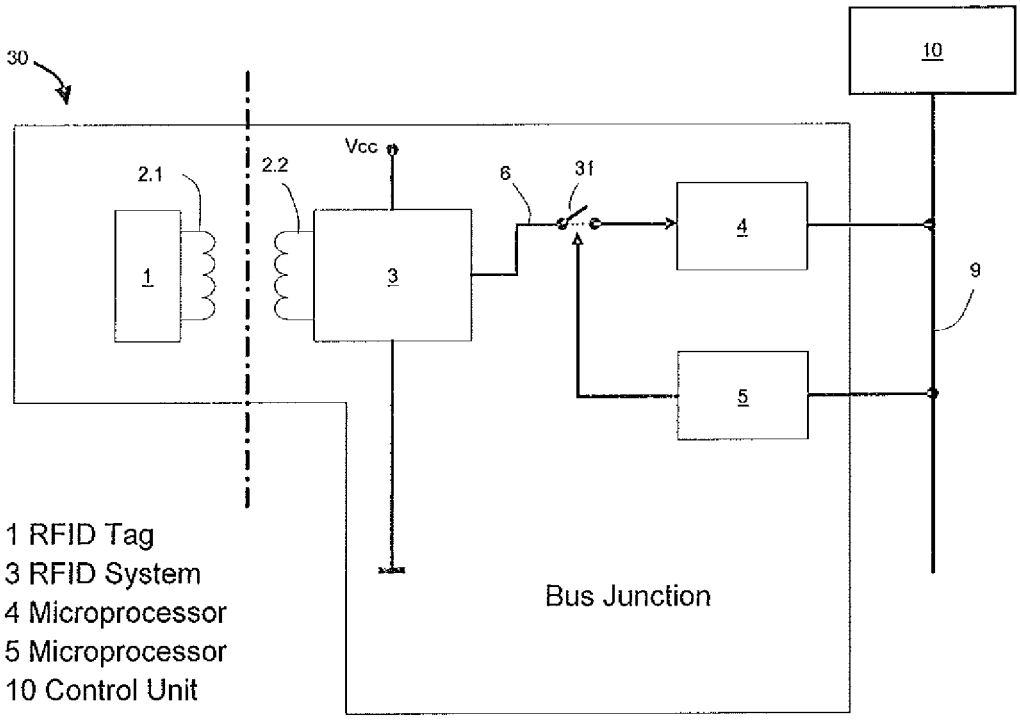
FIG. 1 shows a first exemplifying embodiment of the monitoring system with a switch for interruption of the data line.

FIG. 1 shows a first exemplifying embodiment of the monitoring system as used, for example, in an elevator. A control unit 10 is connected with a bus 9. The control unit 10 communicates with at least one bus junction 30 by way of the bus 9. The control unit 10, the bus 9 and the at least one bus junction 30 form a bus system. Within this bus system each bus junction 30 has a uniquely identifiable address. Signals from the control unit 10 can be selectively communicated to a specific bus junction 30 by means of this address. Equally, incoming signals at the control unit 10 are uniquely assignable to a bus junction 30.

Data can thus be sent in both directions between the bus junction 30 and the control unit 10 by way of the bus 9. The bus junction 30 has for this purpose at least two microprocessors 4 and 5. The two microprocessors 4 and 5 are so designed that the first microprocessor 4 communicates at least status data to the control unit 10 and the second microprocessor 5 receives at least control commands of the control unit 10.

The two microprocessors 4, 6 are capable of configuration both physically and virtually. In the case of two physically configured microprocessors 4, 5, for example, two microprocessors 4, 5 are arranged on one die. In an alternative form of embodiment the two microprocessors 4, 5 can each be realized on an individual die. However, also only one microprocessor 4 can be physically present. In this case a second microprocessor 5 can be configured in virtual form by means of software on the first, physically present microprocessor 4.

The bus junction 30 further comprises at least one code-carrying element 1 and code-reading element 3. For preference, the code-carrying element 1 is an RFID tag 1 and the code-reading element 3 is an RFID system 3.

The exemplifying embodiments of the monitoring system according to FIGS. 1 to 15 are explained in the following on the basis of RFID tags 1 and RFID systems 3. However, a multiplicity of technical possibilities are available to the expert for realization of a contactless transmission of an identification code between a code-carrying and code-reading element. Thus, for example, combinations of code-carrying and code-reading elements 1, 3 as barcode carrier and laser scanner, loudspeaker and microphone, magnetic strip and Hall sensor, magnet and Hall sensor or light source and light-sensitive sensor are also alternatively usable.

Not only the RFID tag 1, but also the RFID system 3 respectively have an induction loop 2.1, 2.2. The RFID system 3 supplies the RFID tag 1 with electromagnetic energy by means of these induction loops 2.1, 2.2. For that purpose the RFID system 3 is connected with an energy source Vcc. The energy source supplies the RFID system 3 preferably either with electrical current or electrical voltage. As long as the RFID tag 1 is supplied with energy the RFID tag 1 transmits an identification code, which is stored on the RFID tag 1, to the RFID system 3 by way of the induction loops 2.1, 2.2. The energy supply Vcc of the RFID tag 1 is only secure if the RFID tag 1 is located in physical proximity below a critical spacing from the RFID system 3 and the induction loop 2.1 of the RFID tag 1 is excitable by the induction loop 2.2 of the RFID system 3. The energy supply Vcc of the RFID tag 1 thus functions only below a critical spacing from the RFID system 3. If the critical spacing is exceeded the RFID tag 1 does not draw sufficient energy in order to maintain transmission of the identification code to the RFID system 3.

The RFID system 3 is connected with the first microprocessor 4 by way of a data line 6 and transmits the received identification code to this first microprocessor 4. The microprocessor 4 compares the identification code with a list, which is stored on a memory unit, of identification codes. In this comparison the microprocessor 4 computes a status value according to stored rules in dependence on the identification code. This status value can in that case adopt a positive or a negative value. A negative status value is, for example, generated when no identification code or a false identification code is communicated to the microprocessor 4.

If a negative status value is present the microprocessor 4 transmits a signal to the control unit 10 by way of the bus 9. This signal contains at least the address of the bus junction 30 as well as preferably the identification code of the detected RFID tag 1. Thanks to the communicated address the control unit 10 is in a position of localizing the origin of the negative status value and initiating an appropriate reaction.

The bus junction 30 monitors, for example, the status of a shaft door. The RFID tag 1 and the RFID system 3 are arranged in the region of the shaft doors such that with closed shaft door the spacing between the RFID tag 1 and the RFID system 3 lies below the critical spacing. The microprocessor 4 thus receives the identification code from the RFID system 3 and generates a positive status value. If the shaft door is opened, the RFID tag 1 and the RFID system 3 exceed the critical spacing. Since the RFID tag 1 is now no longer supplied by the RFID system 3 with electrical energy the RFID tag 1 institutes transmission of its identification code and the microprocessor 4 generates a negative status value. Accordingly, the microprocessor 4 transmits a signal to the control unit 10. Thanks to the address of the bus junction 30 the control unit localizes the open shaft door. If this shaft door is unallowably open, for example no elevator car is located in the shaft door region, the control unit 10 initiates a reaction in order to bring the elevator to a safe state.

A bus junction 30 can monitor the status of further elevator components, such as car doors, door locking means, emergency stop switches or travel switches, in similar manner by means of RFID tag 1 and RFID system 3.

The secure operation of a bus junction 30 primarily depends on the functional capability of the microprocessor 4. Accordingly, a bus junction 30 is regularly tested by the control unit 10 in order to check the spontaneous transmission behavior of the microprocessor 4 in the case of occurrence of a negative status value.

For testing the bus junction 30 according to FIG. 1 the control unit 10 transmits a control command by way of the bus 9 to a second microprocessor 5 to open a switch 31. This switch 31 then interrupts the data line 6 between the RFID system 3 and the first microprocessor 4. The microprocessor 4 receives no identification code and generates a negative status value. A 'disappearance' of the RFID tag 1 is thus simulated. In the case of faultless functioning of the microprocessor 4 this spontaneously reports at the control unit 10.

This test is carried out recurrently over time for each bus junction 30. Since during this test the control unit 10 cannot recognize any real data about the status of the tested bus junction 30 the test time is kept as short as possible and the test is performed only as often as necessary. The test time is in that case largely dependent on the speed of the data transmission by way of the bus 9 and the response time of the microprocessors 4, 5 and is usually 1 to 100 ms. The frequency of the test is primarily oriented to the probability of failure of the overall system. The more reliable the overall system, the less frequently can this be tested, so that a reliable status monitoring of an elevator component is guaranteed.

As a rule the test is carried out at least once daily. However, this test can also be repeated in the order of magnitude of hours or minutes.

Further exemplifying embodiments of the monitoring system, particularly of the bus junction 30, are described in the following. Since the basic construction of the bus junction 30 and the mode of functioning of the bus components 1 to 5 in these exemplifying embodiments is comparable, there is discussion only of the differences in construction and mode of functioning of the different bus junctions 30.

Figure 2:
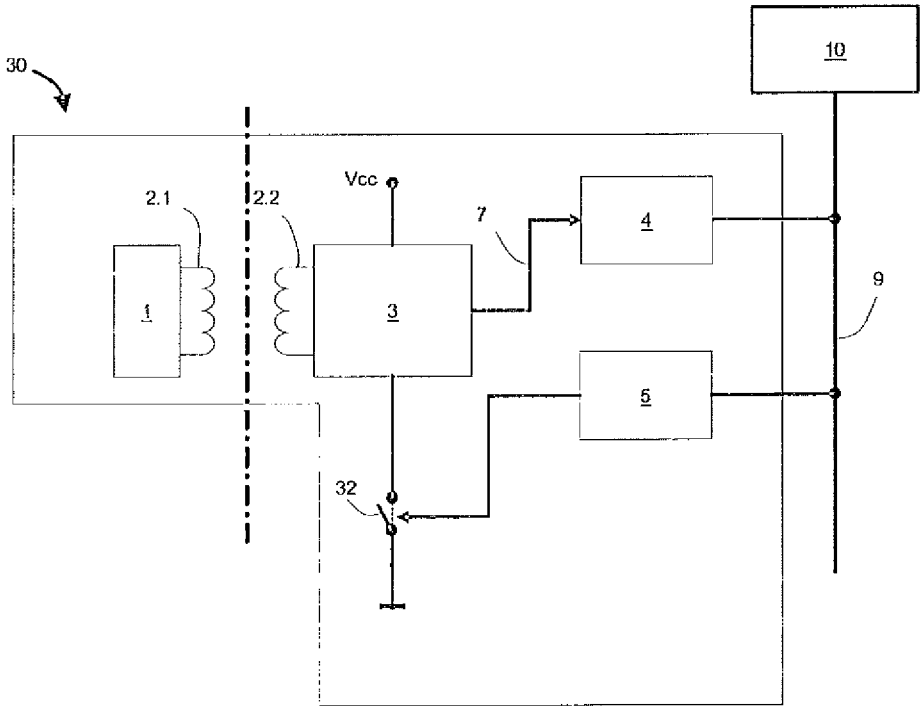
FIG. 2 shows a second exemplifying embodiment of the monitoring system with a switch for interruption of the energy supply to a code-reading element.

FIG. 2 shows a second exemplifying embodiment of the monitoring system. The second microprocessor 5 actuates a switch 32 during testing of the bus junction 30. When the switch 32 is open the energy supply Vcc of the RFID system 3 is interrupted. When the energy source Vcc is switched off the RFID system 3 institutes transmission of the identification code signal to the microprocessor 4 by way of the data line 7.

Figure 3:
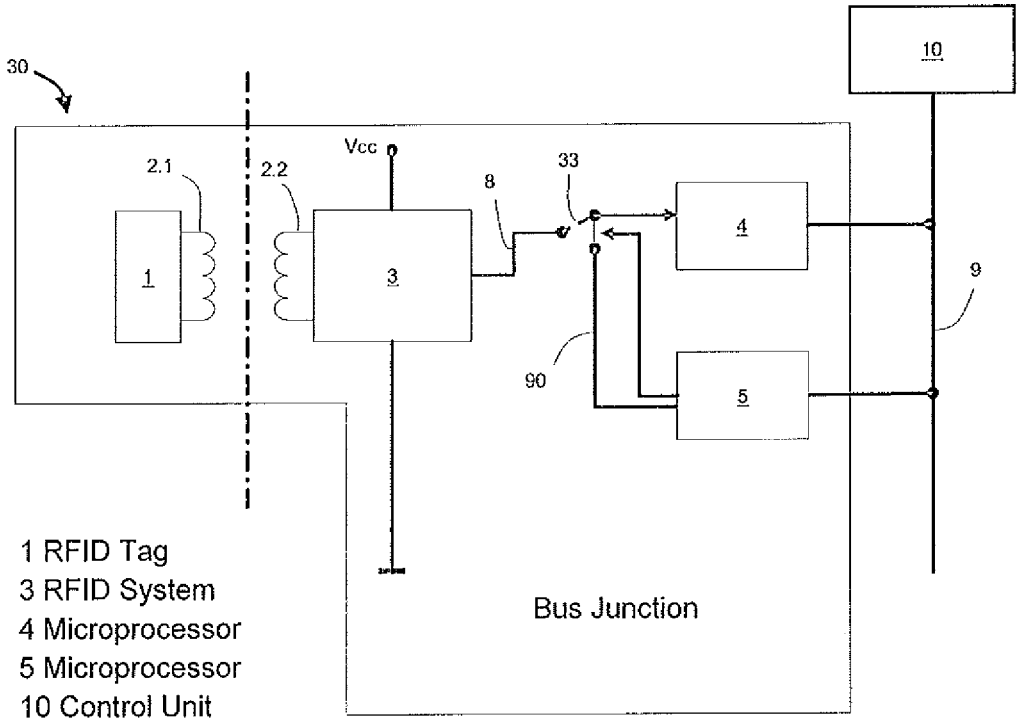
FIG. 3 shows a third exemplifying embodiment of the monitoring system with a switch for interruption of a first data line and closing of a second data line.

FIG. 3 shows a third exemplifying embodiment of the monitoring system. The second microprocessor 5 in this exemplifying embodiment actuates a switch 33 during the test of the first microprocessor 4. In a first switch position this switch 33 connects the RFID system 3 with the first microprocessor 4 by way of the data line 8 and in a second switch position connects the two microprocessors 4 and 5 by means of a further data line 90. The advantage of this exemplifying embodiment is that not only a 'disappearance' of the RFID tag 1 can be simulated, but also the second microprocessor 5 can also preset different identification codes. This is of significance particularly when several RFID tags 1 with different identification codes can enter the reception range of the RFID system 3. Depending on which identification code the second microprocessor 4 reads, this generates a positive or negative status value.

Figure 4:
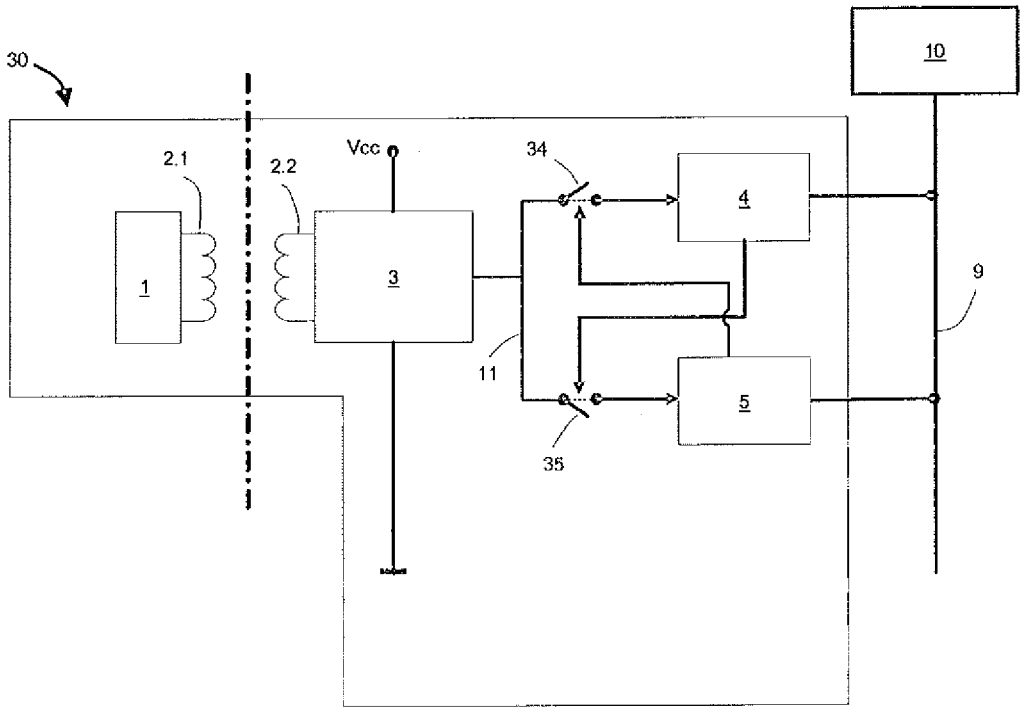
FIG. 4 shows a fourth exemplifying embodiment of the monitoring system with redundant evaluation of the status value and a with a first switch for interruption of a first data line and a second switch for interruption of a second data line.

FIG. 4 shows a fourth exemplifying embodiment of the monitoring system. In this exemplifying embodiment an identification code signal is detected in redundant manner by the two microprocessors 4, 5 via the data line 11 and evaluated. If, thus, at least one of the two microprocessors 4, 5 generates a negative status value a signal is transmitted to the control unit 10 by the bus junction 30. An advantage of this fourth exemplifying embodiment is the redundant and thus very reliable evaluation of the identification code.

During testing of the bus junction 30 one microprocessor 4, 5 interrupts on each occasion the data line 11 between the RFID system 3 and the other microprocessor 5, 4 by means of a switch 34 or 35. During the test of one of the two microprocessors 4, 5 the microprocessor 4, 5 actuating the switch 34, 35 additionally reads the actual identification code of the RFID tag 1. By comparison with the previously described exemplifying embodiments the bus junction 30 thus still remains in a position of transmitting an actual status signal to the control unit 10. The control unit 10 thus recognizes during the test actually occurring negative status communications of a microprocessor 4, 5. In such a case there is not, as expected due to the test, provocation of only a negative status message, but the bus junction 30 would communicate two status signals to the control unit 10, a virtual status and a real status. In the expectation of only one status signal, the control unit 10 recognizes in this case that the bus junction 30 actually has a negative status.

Figure 5:
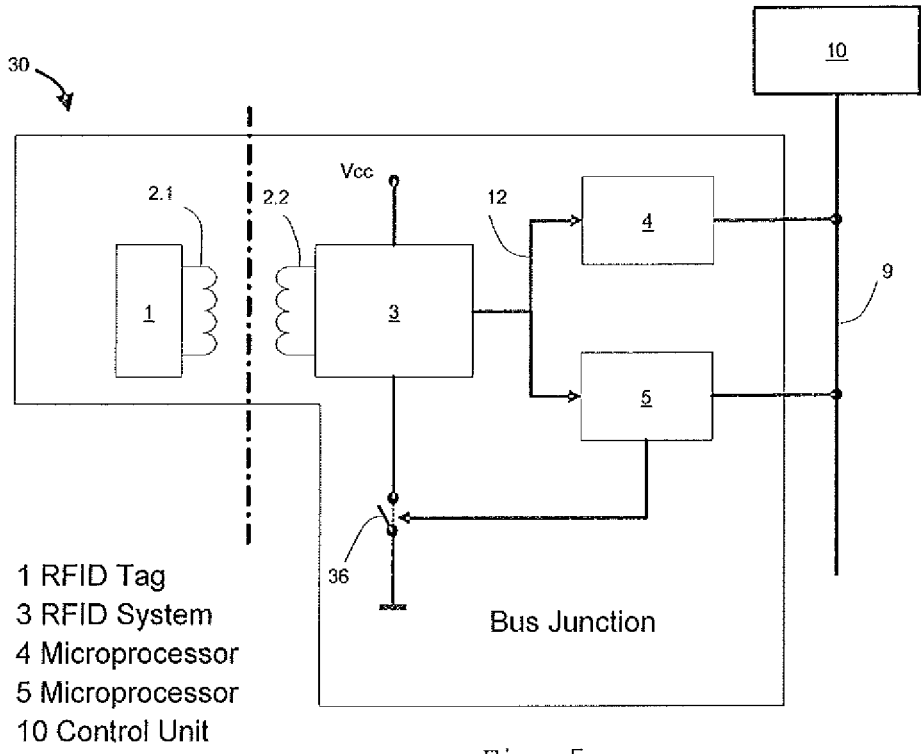
FIG. 5 shows a fifth exemplifying embodiment of the monitoring system with redundant evaluation of the status value and a switch for interruption of the energy supply to a code-reading element.
Figure 6:
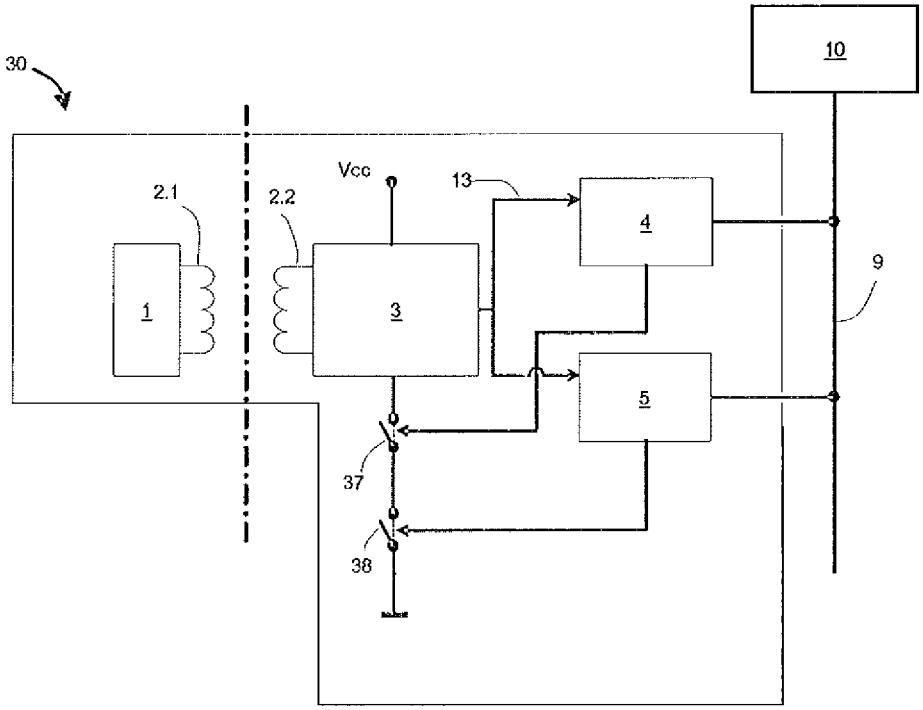
FIG. 6 shows a sixth exemplifying embodiment of the monitoring system with redundant evaluation of the status value and two switches for interruption of the energy supply to a code-reading element.

FIGS. 5 and 6 show a fifth and a sixth exemplifying embodiment of the monitoring system. According to these exemplifying embodiments the identification code signal is similarly redundantly evaluated by the two microprocessors 4, 5 by way of a data line 12 or 13.

In the fifth exemplifying embodiment the control unit 10 during testing of the bus junction 30 transmits a control command for opening a switch 36 to the second microprocessor 5. In the open setting of this switch 36 the energy supply Vcc to the RFID system 3 is interrupted. In the sixth exemplifying embodiment, thereagainst, the energy supply Vcc of the RFID system 3 can be interrupted by two switches 37 and 38 which are respectively switched by the second or first microprocessor 5, 4. In the absence of the identification code signal not only the first, but also the second microprocessor 4, 5 transmit a corresponding signal to the control unit 10.

In the following exemplifying embodiments according to FIGS. 7 to 15 the identification code signals read by the RFID systems 3*a*, 3*b* are communicated by means of different data line arrangements to at least one of the microprocessors 4, 5. Moreover, different switch arrangements for testing the bus junction 30 are also illustrated.

According to these exemplifying embodiments the bus junction 30 comprises two RFID systems 3*a*, 3*b* which each supply a respective RFID tag 1*a*, 1*b* with electrical energy by means of a respective induction loop pair 2.1*a*, 2.2*a*, 2.1*b*, 2.2*b* and receive the identification codes communicated by the RFID tags 1*a*, 1*b*.

Bus junctions 30 which have two RFID systems 3*a*, 3*b* or RFID tags 1*a*, 1*b* can either monitor the status of an elevator element in redundant manner or, however, monitor two different stati of preferably physically adjacent elevator elements. Correspondingly, in the case of an elevator installation, for example, the status of a shaft door can be monitored in redundant manner, or two stati of a car door and of an alarm button positioned on an elevator car can be monitored, by means of two RFID systems 3*a*, 3*b* and two RFID tags 1*a*, 1*b*.

Figure 7:
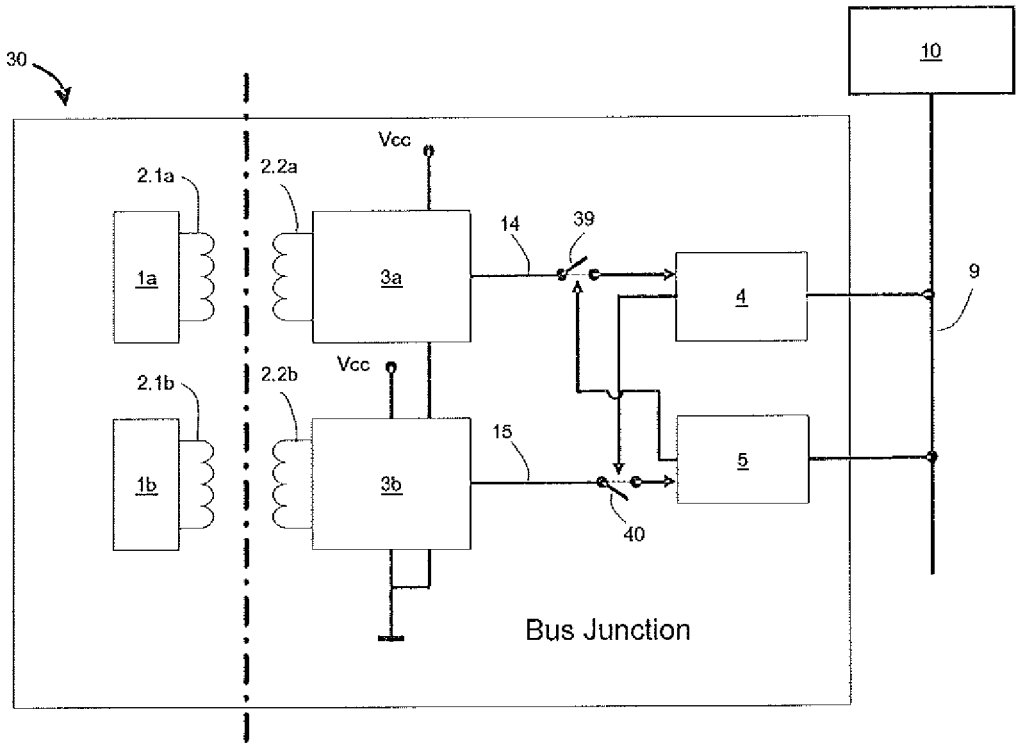
FIG. 7 shows a seventh exemplifying embodiment of the monitoring system with two RFID systems and a first switch for interruption of a first data line as well as a second switch for interruption of a second data line.
Figure 8:
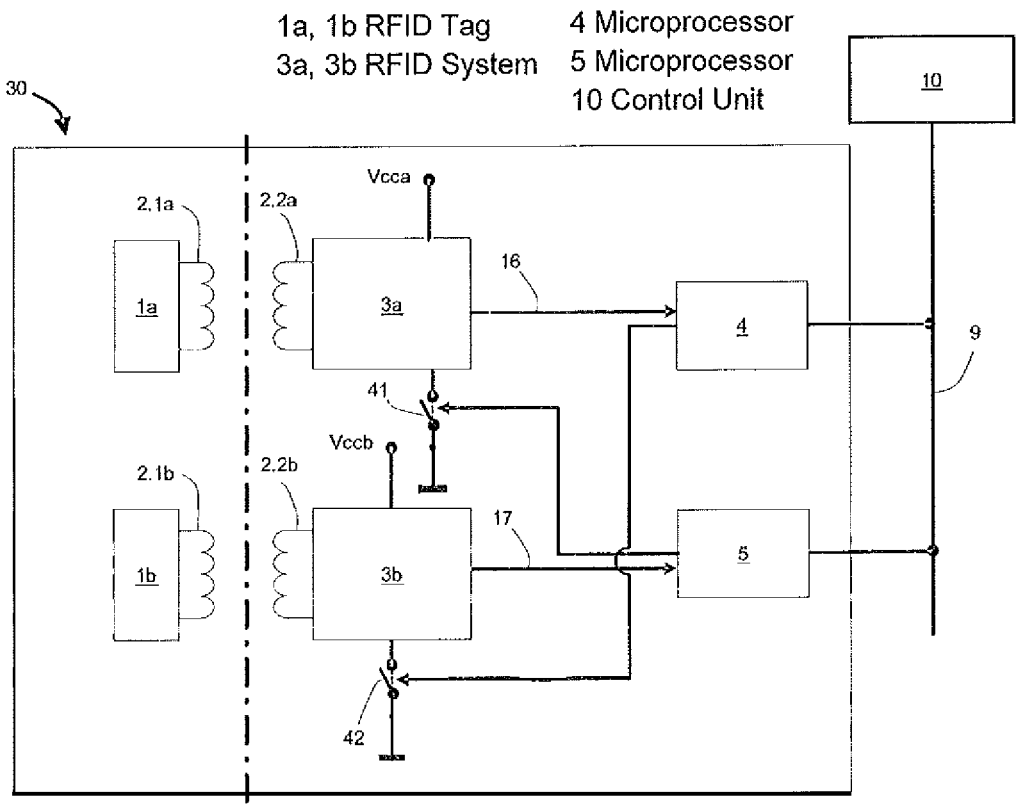
FIG. 8 shows an eighth exemplifying embodiment of the monitoring system with two RFID systems and a first switch for interruption of the energy supply to a first code-reading element as well as a second switch for interruption of the energy supply to a second code-reading element.
Figure 9:
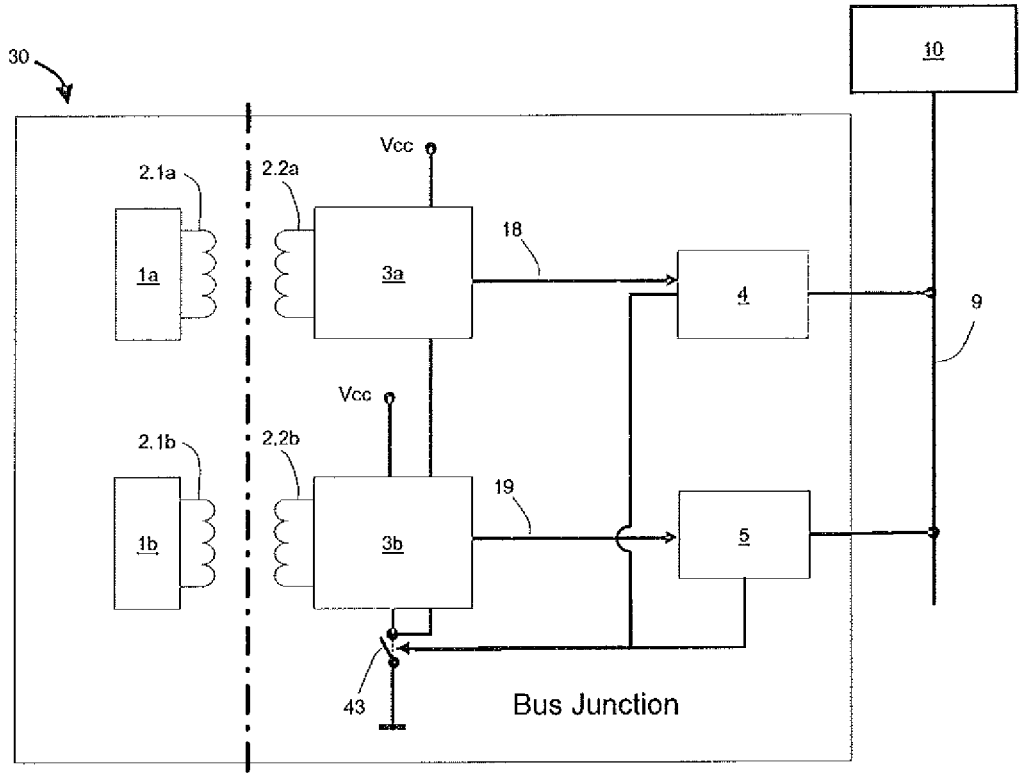
FIG. 9 shows a ninth exemplifying embodiment of the monitoring system with two RFID systems and a switch for interruption of the energy supply to two code-reading elements.

In the exemplifying embodiments according to FIG. 7 to FIG. 9 the two RFID systems 3*a*, 3*b* communicate the detected identification code by way of a respective data line 14, 15, 16, 17, 18, 19 to a microprocessor 4, 5. FIG. 7 shows a bus junction 30, the functional capability of which is carried out by means of reciprocal interruption of the data line 14, 15 by means of a switch 39, 40. Correspondingly, a first microprocessor 4 receives from the control unit 10 the instruction to interrupt the data line 15 to the second microprocessor 5 by means of switch 40 and the second microprocessor 5 receives from the control unit 10 the instruction to interrupt the data line 14 to the first microprocessor 4 by means of switch 39.

By contrast to the exemplifying embodiment of FIG. 7, in FIGS. 8 and 9 the spontaneous response behavior of the microprocessors 4, 5 is provoked by interruption of the respective energy supply Vcca, Vccb to an RFID system 3*a*, 3*b*. In the exemplifying embodiment according to FIG. 8 the control unit 10 in each instance instructs a first microprocessor 4, 5 to open a switch 41, 42 for energy supply Vcca, Vccb of the RFID system 3*b*, 3*a* connected with the second microprocessor 5, 4, and conversely.

In the exemplifying embodiment according to FIG. 9, thereagainst, the two microprocessors 4, 5 actuate the same switch 43, which interrupts the feed of the energy supply Vcc to the two RFID systems 3*a*, 3*b*. If, for example, the first microprocessor 4 opens the switch 43 not only the second microprocessor 5 spontaneously reports at the control unit 10, but also the first microprocessor 4. Equally, the two microprocessors 4, 5 report at the control unit 10 when the switch 43 is actuated by the second microprocessor 5.

Figure 10:
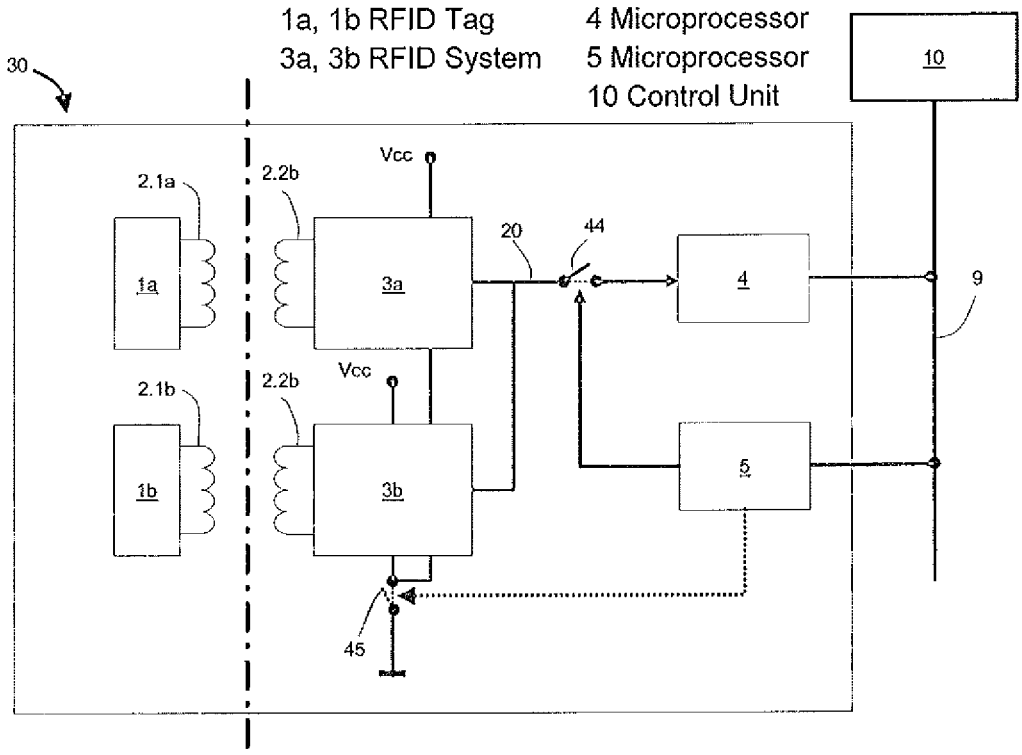
FIG. 10 shows a tenth exemplifying embodiment of the monitoring system with two RFID systems and a switch for interruption of the data line or an alternative switch for interruption of the energy supply to two code-reading elements.

FIG. 10 shows an exemplifying embodiment in which RFID systems 3*a*, 3*b* communicate their identification code to a first microprocessor 4 by means of a data line 20. A second microprocessor 5 tests the functional capability of the first microprocessor 4. In this test the second microprocessor 5 actuates a switch 44 and thus interrupts the data line 20. In an alternative arrangement of this switch the second microprocessor 5 interrupts the energy supply Vcc of the two RFID systems 3*a*, 3*b* by means of the switch 45. This alternative test arrangement is illustrated in FIG. 10 by dotted lines.

Figure 11:
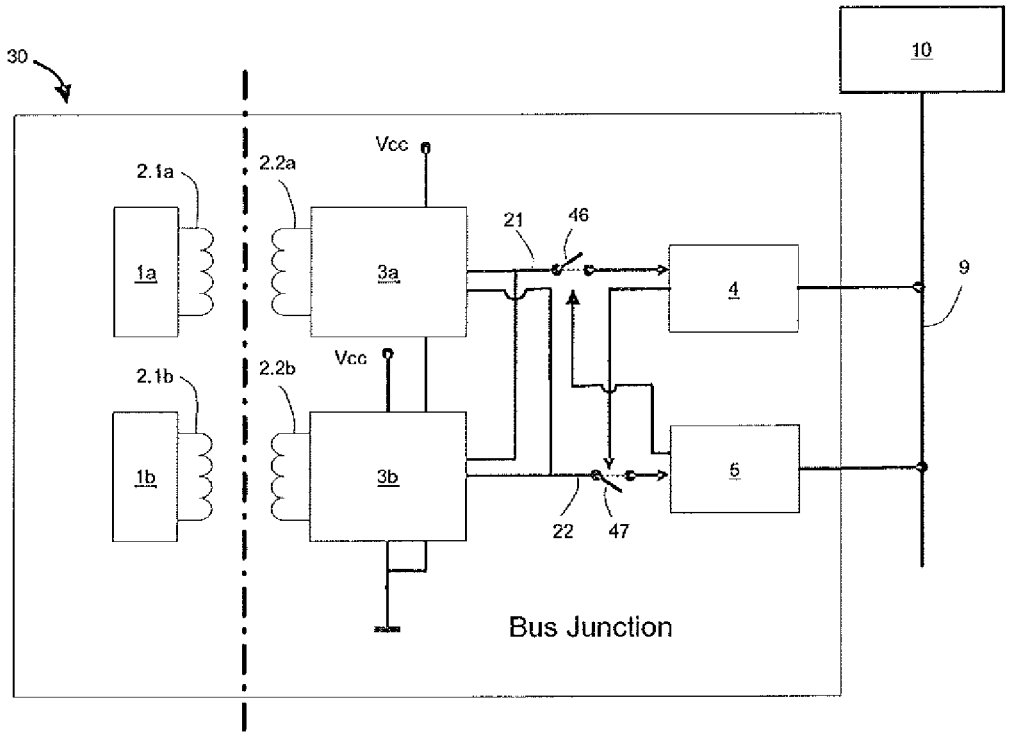
FIG. 11 shows an eleventh exemplifying embodiment of the monitoring system with two RFID systems, redundant evaluation of the status values and a first switch for interruption of a first data line as well as a second switch for interruption of a second data line.
Figure 12:
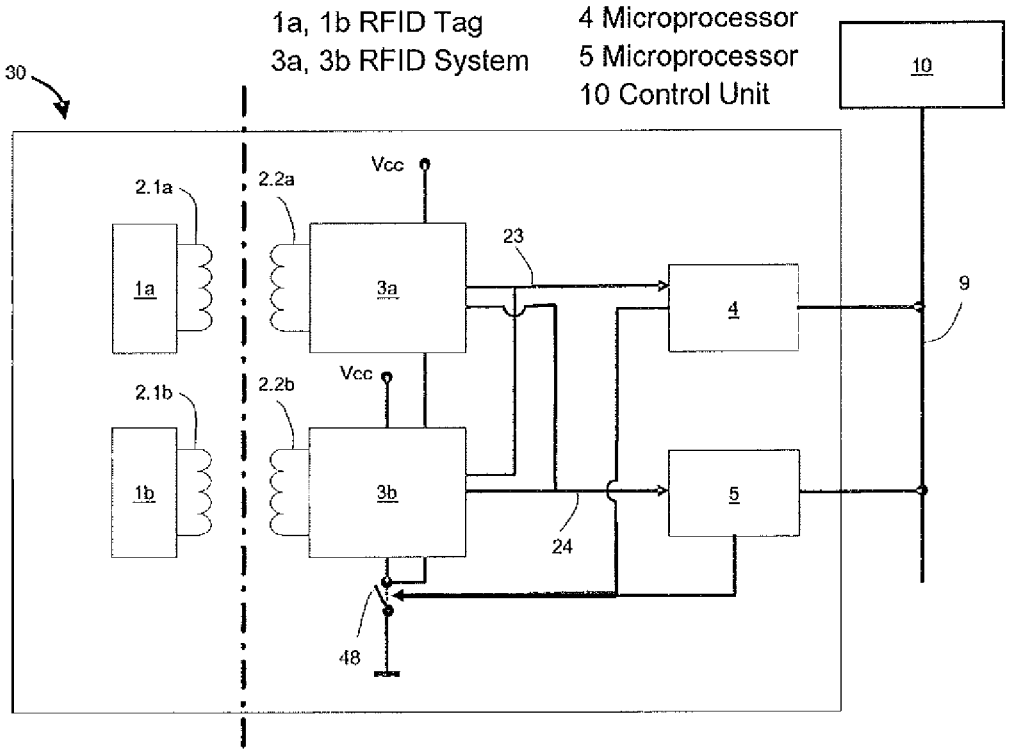
FIG. 12 shows a twelfth exemplifying embodiment of the monitoring system with two RFID systems, redundant evaluation of the status values and a switch for interruption of the energy supply to two code-reading elements.
Figure 13:
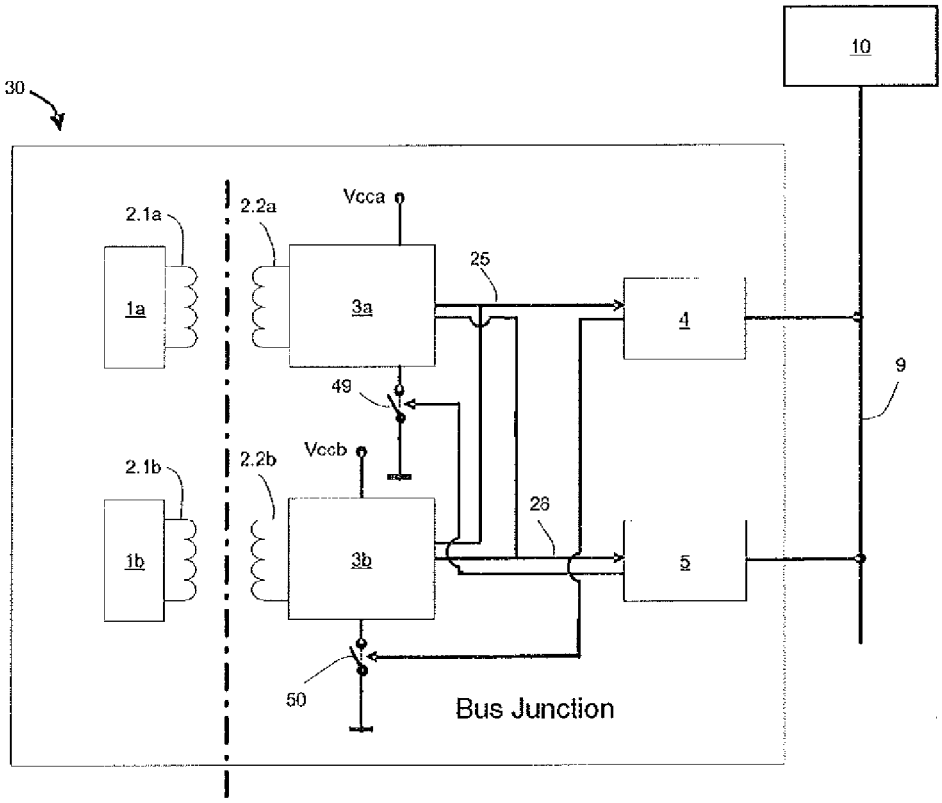
FIG. 13 shows a thirteenth exemplifying embodiment of the monitoring system with two RFID systems, redundant evaluation of the status values and a first switch for interruption of the energy supply to a first code-reading element as well as a second switch for interruption of the energy supply to a second code-reading element.

Exemplifying embodiments of monitoring systems are similarly illustrated in FIGS. 11 to 13, which systems have two RFID systems 3*a*, 3*b* which each supply a respective RFID tag 1*a*, 1*b* with energy and read the identification code thereof. The evaluation of the read identification code is in that case carried out in redundant manner, since the two RFID systems communicate the respectively read identification code by way of a data line 21, 22, 23, 24, 25, 26 to both the first microprocessor 4 and the second microprocessor 5. The bus junction 30 according to one of these three exemplifying embodiments is, however, tested in a different way.

In FIG. 11 the first microprocessor 4 controls a switch 47 for opening a data line 22 between the second microprocessor 5 and the two RFID systems 3*a*, 3*b*. In that case the spontaneous response behavior of the microprocessor 5 is tested. The second microprocessor 5 in turn, during testing of the first microprocessor 4, opens the data line 21 between the first microprocessor 4 and the RFID systems 3*a*, 3*b* by means of a further switch 46 and causes this to transmit a signal to the control unit 10.

In the exemplifying embodiment according to FIG. 12 the energy supply Vcc of the RFID systems 3*a*, 3*b* is interrupted by means of a switch 48 during testing of the microprocessors 4, 5. This switch is actuated in each instance by one of the microprocessors 4, 5. If the switch 48 is actuated, the two microprocessors 4, 5 communicate a signal to the control unit 10.

The exemplifying embodiment of FIG. 13 differs from that of FIG. 12 insofar as the RFID systems 3*a*, 3*b* each have an own energy supply Vcca and Vccb. Moreover, each of these energy supplies Vcca, Vccb can be individually switched off by a separate switch 49, 50. This is carried out in each instance by one of the microprocessors 4, 5. In FIG. 13, for example, the microprocessor 4 switches the switch 50 of the energy supply Vccb and the microprocessor 5 switches the switch 49 of the energy supply Vcca. If the microprocessors 4, 5 function free of fault, these report simultaneously on actuation of a switch 49, 50, since, for example, on interruption of the energy supply Vcca the RFID system 3*a* fails and correspondingly the identification code is communicated neither to the first microprocessor 4 nor to the second microprocessor 5 by means of the data line 25, 26.

Figure 14:
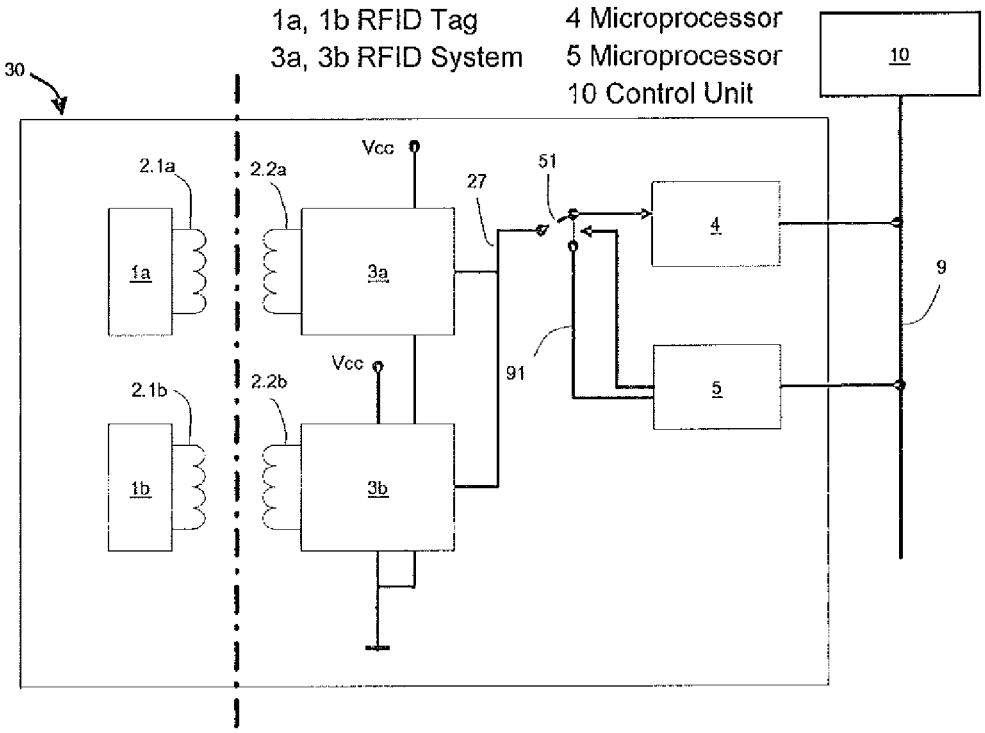
FIG. 14 shows a fourteenth exemplifying embodiment of the monitoring system with two RFID systems and a switch for interruption of a first data line and closing of a second data line.
Figure 15:
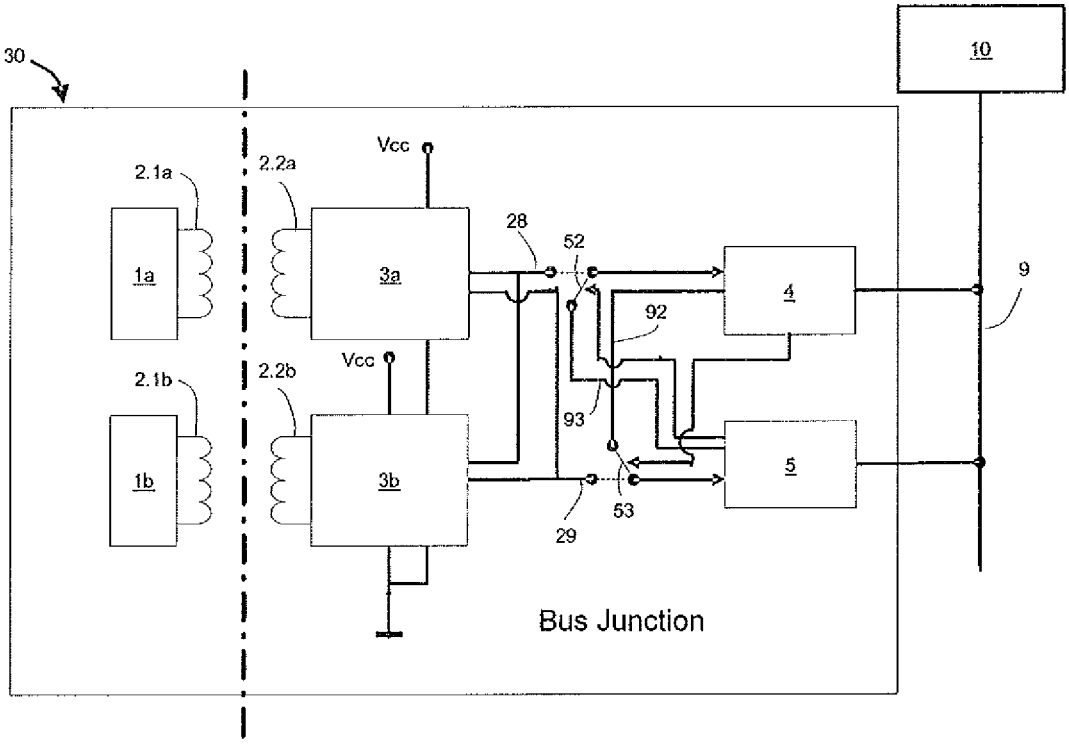
FIG. 15 shows a fifteenth exemplifying embodiment of the monitoring system with two RFID systems, redundant evaluation and a first switch for interruption of a first data line and closing of a second data line as well as a second switch for interruption of a third data line and closing of a fourth data line.

FIGS. 14 and 15 illustrate further exemplifying embodiments of the monitoring system. In the first exemplifying embodiment according to FIG. 14 the second microprocessor 5 actuates a switch 51 during the test of the first microprocessor 4. This switch 51 in a first switch position connects the RFID systems 3*a*, 3*b* with the first microprocessor 4 by means of the data line 27 and in a second switch position connects the two microprocessors 4, and 5 by means of a further data line 91. In the exemplifying embodiment according to FIG. 15 in each instance one of the two microprocessors 4, 5 actuates a switch 52, 53, which in a first switch position connects the RFID systems 3*a*, 3*b* with the other microprocessor 5, 4 by means of a data line 28, 29. In a second switch position in each instance the one microprocessor 4, 5 is connected with the other microprocessor 5, 4 by means of a respective further data line 92, 93.

The advantage of these two exemplifying embodiments is that not only can a disappearance of the RFID tags 1*a*, 1*b* be simulated, but also the microprocessor 4, 5 actuating the switches can also preset different identification codes from the other microprocessor 5, 4. This is of significance particularly when several RFID tags 1*a*, 1*b* with different identification codes can enter the reception range of the RFID systems 3*a*, 3*b*. Depending on which identification code is read by the first or second microprocessor 4, 5, a positive or negative status value is generated.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator with a control unit, a bus, a first microprocessor and at least a second microprocessor, which first and second microprocessors are associated with a bus junction and which are connected by the bus with the control unit, comprising:

the control unit is operable to communicate an instruction by the bus to the second microprocessor;

the second processor is responsive to the instruction to interrupt a signal transmission from a signal source to the first microprocessor; and the first microprocessor is responsive to the signal interruption to transmit a status message to the control unit.

2. The elevator according to claim 1 wherein the signal source includes at least one code-carrying element and at least one code-reading element associated with the bus junction, the at least one code-reading element contactlessly reading an identification code from the at least one code-carrying element and responding by transmitting the signal to the first microprocessor.

3. The elevator according to claim 2, wherein the at least one code-carrying element and the at least one code-reading element each have an induction loop, the at least one code-reading element contactlessly supplying the at least one code-carrying element with electromagnetic energy by the two induction loops and the at least one code-carrying element contactlessly communicating the identification code to the at least one code-reading element by the two induction loops.

4. The elevator according to claim 2, wherein the at least one code-reading element communicates the signal to at least the first microprocessor by a data line connected therebetween.

5. The elevator according to claim 2, wherein the at least a second microprocessor actuates a switch to interrupt the signal transmission by interruption of a data line between the first microprocessor and the at least one code-reading element or by interruption of an energy supply of the at least one code-reading element.

6. The elevator according to claim 1, wherein the control unit confirms the status message from the first microprocessor by interruption of transmission of the signal from the signal source to the second microprocessor.

7. A method of monitoring an elevator having a control unit, a bus, a first microprocessor and at least a second microprocessor, which first and second microprocessors are associated with a bus junction and which are connected with the control unit by the bus, wherein the method comprises the steps of:

communicating an instruction from the control unit to the second microprocessor;

operating the second microprocessor to interrupt a signal transmission from a signal source to the first microprocessor in response to the instruction; and transmitting a status report from the first microprocessor to the control unit based upon the signal interruption.

8. The method according to claim 7 wherein the signal source includes at least one code-carrying element and at least one code-reading element, which elements are associated with the bus junction, further including the steps of:

contactlessly reading an identification code of the code-carrying element by the code-reading element; and deriving from the identification code the signal that is transmitted to the first microprocessor by the code-reading element.

9. The method according to claim 8 including communicating the signal by a data line connected between the code-reading element the first microprocessor.

10. The method according to claim 9 including actuating a switch by the second microprocessor to interrupt the data line or interrupt an energy supply of the code-reading element.

11. The method according to claim 7 including confirming the status report of the first microprocessor by interrupting transmission of the signal from the signal source to the second microprocessor.

* * * * *